US005687671A

United States Patent [19]

Gates

[11] Patent Number: 5,687,671

[45] Date of Patent: Nov. 18, 1997

[54] UNDERWATER PROPULSION DEVICE

[75] Inventor: Alfred A. Gates, Moodus, Conn.

[73] Assignee: The United States of America as represented by the Secretary of the Navy, Washington, D.C.

[21] Appl. No.: 636,999

[22] Filed: Apr. 17, 1996

[51] Int. Cl.[6] ..... B63C 11/46

[52] U.S. Cl. ..... 114/315; 440/44

[58] Field of Search ..... 440/38, 44; 114/244, 114/337

[56] References Cited

U.S. PATENT DOCUMENTS

| | | | |
|---|---|---|---|
| 2,312,976 | 3/1943 | Pels | 440/38 |
| 2,983,244 | 5/1961 | Young | 440/44 |
| 3,048,140 | 8/1962 | Davis | 440/38 |
| 3,965,611 | 6/1976 | Pippin | 46/74 B |
| 4,057,961 | 11/1977 | Payne | 440/38 |
| 4,341,173 | 7/1982 | Hagelberg et al. | 114/337 |

*Primary Examiner*—Stephen Avila

*Attorney, Agent, or Firm*—Michael J. McGowan; James M. Kasischke; Prithvi C. Lall

[57] ABSTRACT

Disclosed is a water jet propulsion device for divers and diver equipment. A forward pressurized air chamber and a rearward water containing chamber are positioned inside a cylindrical housing and are separated by a flexible membrane which is adjacent to a conical deformation plate. On opening a valve located in communication with the water containing housing, pressurized air in the air chamber forces water from the water chamber through a nozzle to the exterior of the housing until the flexible membrane expands to bear against the conical rearward deformation plate. The device is thus moved in a forward direction along with its attached swimmer or equipment.

18 Claims, 6 Drawing Sheets

UNDERWATER PROPULSION DEVICE

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

The present invention relates to marine propulsion systems and, more particularly, to water jet devices for propelling divers and their equipment.

(2) Description of the Prior Art

The U.S. Navy uses a swimmer deployment vehicle launched from a dry dock shelter attached to a submarine in order to deploy swimmers. During deployment of the swimmer delivery vehicle, the vehicle, the submarine and the deployed swimmer are all subject of an increased risk of detection. Furthermore, many undersea activities require the brief application of thrust to overcome the inertia of heavy equipment. This device should be portable and easily attachable to the equipment.

Various devices have been suggested in the prior art for the purpose of propelling divers and their equipment. U.S. Pat. No. 2,312,976 to Pels, for example, discloses a swimmer worn water propulsion device in which bladders are filled with water or water and air. When pressure is applied to the bladder, the water exits an outlet to propel the swimmer forward.

U.S. Pat. No. 3,048,140 to Davis, Sr. discloses a portable underwater propulsion device for use by divers in which an underwater ram jet engine is mounted on the back of the diver. The engine is operated by injecting gas under pressure into the engine duct at a point where the static pressure of the water is greater.

U.S. Pat. No. 4,341,173 to Hagelberg et al. discloses an underwater propulsion system in which a propulsion chamber is filled with water gas generators then pressurize the chamber to force water out through a nozzle.

While not specifically directed toward propelling a diver, U.S. Pat. No. 3,965,611 to Pippin, Jr. discloses a toy missile propelled by the release of pressurized air and water through an outlet. An internal chamber holds the water and pressurized air.

While the devices heretofore proposed would appear to provide some assistance to the diver, a need exists for a device which operates at high efficiency to minimize deployment time for divers and thereby decrease the risk of detection. Also needed is a portable device to provide thrust to underwater objects.

SUMMARY OF THE INVENTION

Accordingly, a first object of the subject invention is the provision of a device applying a force to a swimmer or object.

Another object of the invention is provision of a portable force application device.

Yet another object of such device is that it be mechanically simple and reusable.

The water jet propulsion device of this invention is the cylindrically shaped with a flange approximately in the longitudinal center of the cylinder. An elastomeric membrane is disposed in the cylinder to separate compressed gas and water from mixing in the cylinder. A nozzle and a water valve are positioned in communication between the inside of the cylinder and environmental water. A deformation plate is positioned in the cylinder to prevent over deformation of the membrane. During the charge phase the aft end of the cylinder is filled with water while the forward end is pressurized with air. To operate the propulsion device of this invention, the water valve is opened thereby allowing communication of water inside the cylinder with the environment through the nozzle thereby providing thrust. The elastomeric membrane will prevent the gas from escaping from the cylinder, and the deformation plate prevents tearing of the membrane during use.

BRIEF DESCRIPTION OF THE DRAWINGS

The present invention will be more fully understood when the following description is read in light of the accompanying drawings in which.

DESCRIPTION OF THE PREFERRED EMBODIMENT

Figure 1:
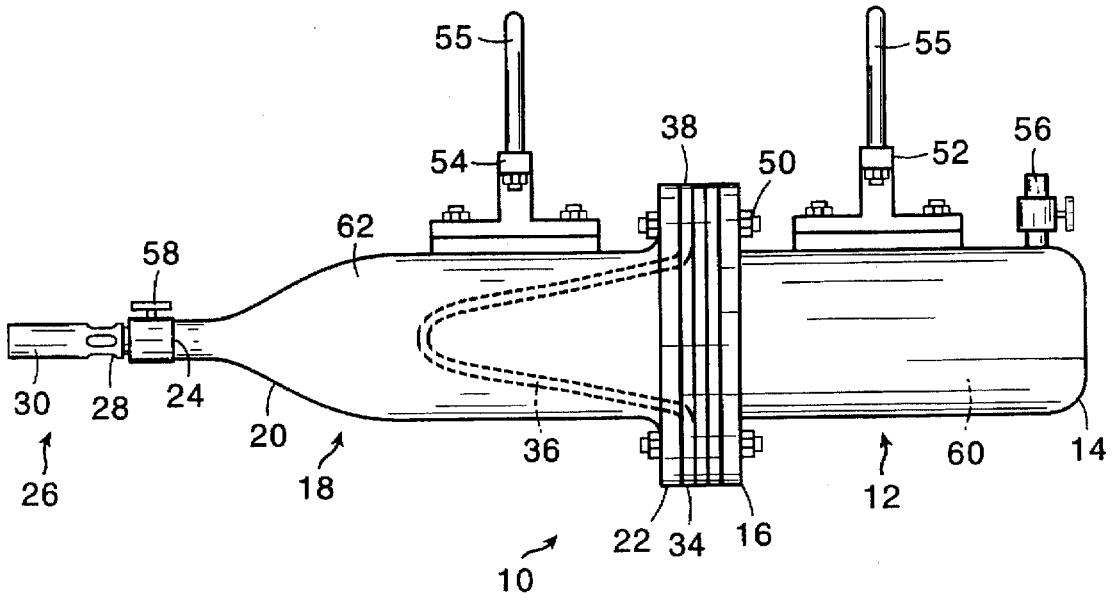
FIG. 1 is a side elevational view of a preferred embodiment of the water jet propulsion device of the present invention.
Figure 2:
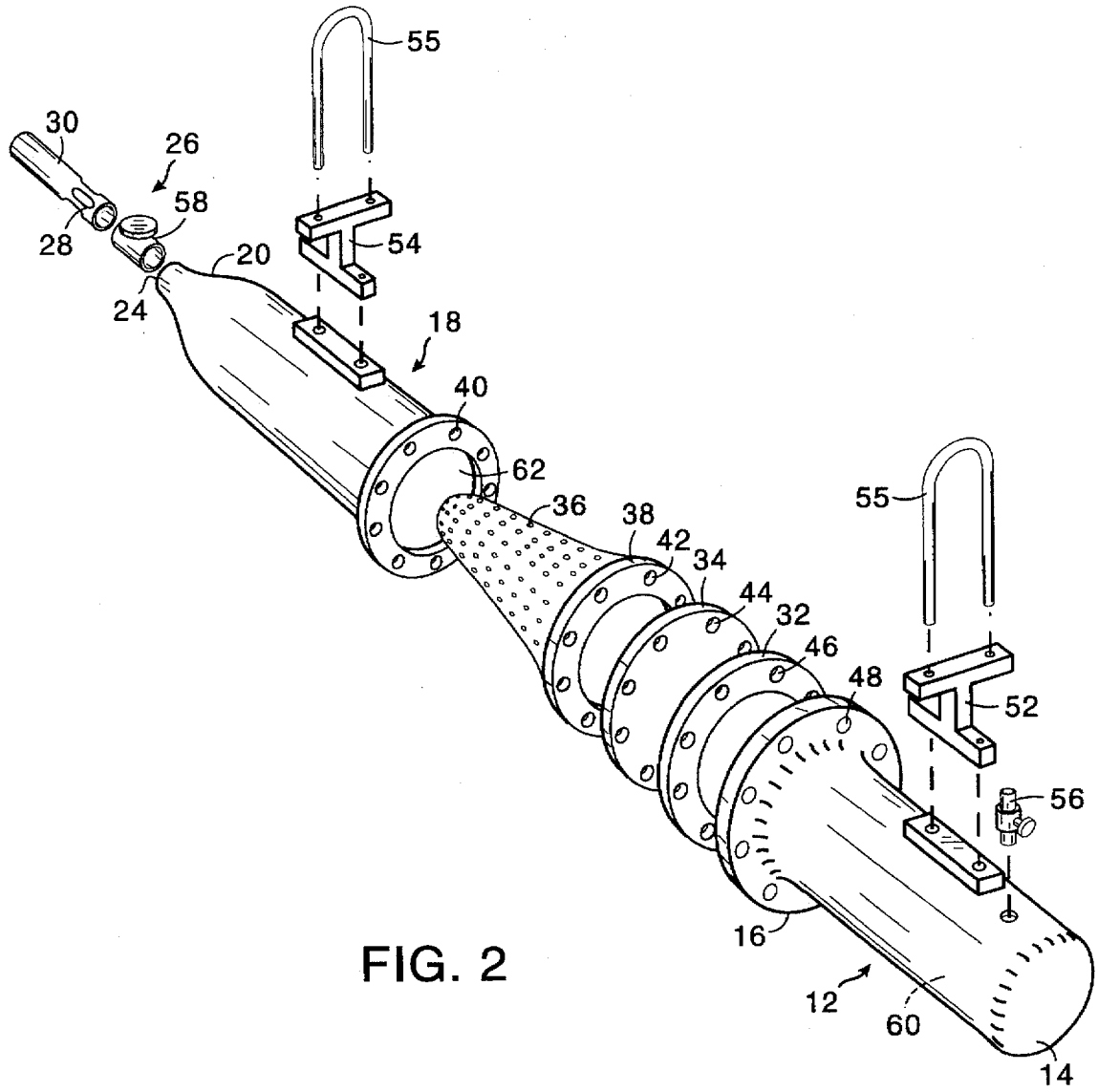
FIG. 2 is a perspective exploded view of the water jet propulsion device shown in FIG. 1.

Referring particularly to FIGS. 1 and 2, the propulsion device of the present invention includes a rigid housing shown generally at numeral 10 which is preferably constructed of aluminum. This housing is comprised of a forward section shown generally at numeral 12 having a rounded front end 14 and a rear terminal peripheral flange 16. The housing 10 also includes an aft section shown generally at numeral 18 having a tapered aft end 20 and a forward terminal flange 22. From the aft end 20 of the aft section 18 there is a tubular aft projection 24 which is connected to a nozzle shown generally at numeral 26. This nozzle 26 is comprised of a front nozzle section 28 and a rear nozzle section 30. Interposed between the front housing section 12 and rear housing section 18 is a gasket 32 and an expandable elastomeric membrane 34. The elastomeric membrane 34 can be expanded rearwardly until it is restrained by a water permeable conical deformation plate 36 which has a forward peripheral flange 38. There are aligned apertures peripherally arranged around the aft section flange, the deformation plate flange, the elastomeric membrane, the gasket and the forward section flange as at 40, 42, 44 and 48 respectively. Bolts 50 pass through the aligned apertures to fasten forward and aft housing sections 12 and 18 together. A forward mounting bracket 52 and an aft mounting bracket 54 are attached respectively to the forward housing section 12 and aft housing section 18 for attachment. A mounting member 55 can be affixed to each bracket 52 and 54. The forward housing section 12 is also equipped with an air valve 56, and the aft housing section 18 is equipped with a nozzle adjustment valve 58. Inside the housing 10 and forward of the elastomeric membrane 34 is a pressurized air chamber 60. Inside the housing 10 and rearward of the elastomeric membrane 34 there is a water containing chamber 62.

In operation, the water containing chamber 62 is initially filled with water. With the nozzle adjustment valve 58 being closed, the forward pressurized air chamber 60 is filled with air through the air valve 56. At this point, the elastomeric membrane 34 will be essentially unextended oriented generally perpendicularly with respect to the longitudinal axis of housing 10. When the nozzle adjustment valve 58 is opened, the pressurized air in the pressurized air chamber 60 will extend the elastomeric membrane 34 rearwardly to force water from the aft water containing chamber 62 rearwardly through the nozzle 26 and to the exterior of the housing 10. This water jet effect will push the housing 10 in a forward direction along with the diver and/or equipment to which the housing 10 is attached. Such forward motion caused by forcing water through the nozzle 26, will continue until the elastomeric membrane 34 is extended rearwardly to abut the conical deformation plate 36.

EXAMPLE

Figure 3:
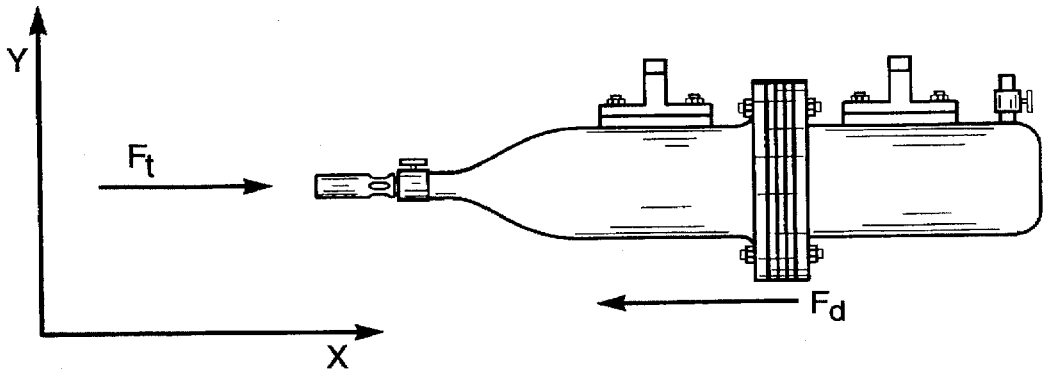
FIG. 3 is a view similar to FIG. 1 in which the horizontal force balance on the water jet propulsion device of the present invention is illustrated.

The force balance in the horizontal direction of the water jet propulsion device of this invention is displayed in FIG. 3 and represented by equation (1).

$$\Sigma F_x = ma_x = F_t - F_d \tag{1}$$

Where:

m=mass $a_x$=acceleration of the horizontal direction $F_t$=thrust force from the water jet $F_d$=hydrodynamic drag force The thrust force can be expressed as the product of the pressure difference (between tank depth and escaping fluid pressure) and the area of the valve opening (equation (2)).

$$F_t = (P_t(t) - P_d)A_v \tag{2}$$

Where:

$P_t(t)$=pressure of fluid leaving tank (time dependant)

$P_d$=pressure associated with tank depth $A_v$=cross sectional area of fluid valve opening Assuming the air in the tank is a perfect gas, the pressure of the fluid leaving the tank can be written as equation (3) [2].

$$P_t(t) = \frac{RTm_a}{v_a(t)} \tag{3}$$

Where:

R=universal gas constant

T=temperature of air in the tank $m_a$=mass of air in tank $v_a(t)$=volume of air at temperature T and time t These calculations assume that the pressure on the fluid exiting the tank is not decreased due to head loss from the water valve. As fluid exits the tank the air volume increases. The volume of air can be expressed in terms of the velocity of fluid leaving the tank (equation (4)).

$$v_a(t) = A_v V_f(t) + V_{ti} \tag{4}$$

Where:

$A_v$=same as equation (2)

$v_f(t)$=velocity of fluid leaving the tank $V_{ti}$=initial volume of air in tank The velocity of fluid exiting the tank is expressed in terms of nozzle efficiency (equation(5)).

$$v_f(t) = \left| \frac{2P_t(t) - P_d}{\rho E\left(1 - \left(\frac{Av}{An}\right)^2\right)} \right|^{1/2} \tag{5}$$

Where:

$P_t(t)$=same as equation (2)

$P_d$=same as equation (2)

ρ=density of water

E=nozzle efficiency (0.8)

$A_v$=same as equation (2)

$A_n$=area of nozzle exit $F_d$ from equation (1) is the total drag of the tank as a function of tank velocity. The drag force can be expressed in terms of equation (6).

$$F_d = C_d \rho A_b \frac{v^2(t)}{2} \tag{6}$$

Where:

$C_d$=drag coefficient

V(t)=tank velocity (time dependent)

$A_b$=area of tank perpendicular to movement of tank

A drag coefficient of 0.5 was used. Substituting equations (2) and (6) into (1) provides equation (7) as a function of time.

$$m(t)\frac{dv(t)}{dt} = (P_t(t) - P_d)A_v - \frac{Cd}{2}\rho V^2(t)A_b \tag{7}$$

The mass of the tank includes the fluid used for thrust force therefor it is time dependent. The tank velocity is also time dependent. Equation (7) can be numerically integrated by applying central difference techniques. This leads to equation (8).

$$[{}^{t+\delta t}v - {}^{t-\delta t}v]\, m(t)\frac{[{}^{t+\delta t}v - {}^{t-\delta t}v]}{[2\delta t]} = (P_t(t) - P_d)A_v - \frac{C_d \rho {}^t v^2 A_b}{2} \tag{8}$$

Solving for ${}^{t+\delta t}v$, results in equation (9), $${}^{t+\delta t}v = {}^{t-\delta t}v + \frac{2\delta t}{m(t)}\left([P_t(t) - P_d]A_v - \frac{C_d \rho {}^t v^2 A_b}{2}\right) \tag{9}$$

The mass at time t is now expressed as (10).

$$m(t) = m_i - \Sigma v_f(t) A_v \delta t \tag{10}$$

Where:

$m_i$=initial mass of tank and internal contents.

The velocity of the fluid leaving the tank depends on the air pressure at time t (equation (5)). The air pressure at time t is solved for using equation (3). The volume of air can be numerically represented by equation (11) rather than by equation (4).

$$v_a(t) = A_v \sum_{i=1}^{n} v_f(t)\delta t + v_{ai} \tag{11}$$

Where:

$v_a(t)$=volume of air at time t $m_a$=mass of air in tank $v_{ai}$=initial volume of air in tank Tank movement and thrust force can be numerically represented by applying the following conditions:

$v(t=0)=0$ $P_t(t=0)=P_{ti}$ $m(t=0)=m_t$

The first time step is for a time of δt. If δt is small, the drag force is small and can be ignored reducing equation (8) to:

$$\delta_{tv}=\frac{A_v\delta t}{m(t)}\,(P_t(t)-P_d) \tag{12}$$

Using $v_t(t)$ at t=0 from equation (5) and combining with equations (3) and (10), $P_t(t)$ and m(t) can be solved for at time t=δt. Equation (12) is solved to provide the tank velocity at t=δt. For the remaining iterations equation (9) is used to solve for the tank velocity along with updating $v_t(t)$, $P_t(t)$ and m(t). The thrust force will terminate when the rubber membrane is against the deformation plate which can be determined by computing the volume of air at this condition. The velocity of the tank will eventually become zero due to the drag force.

Figure 4:
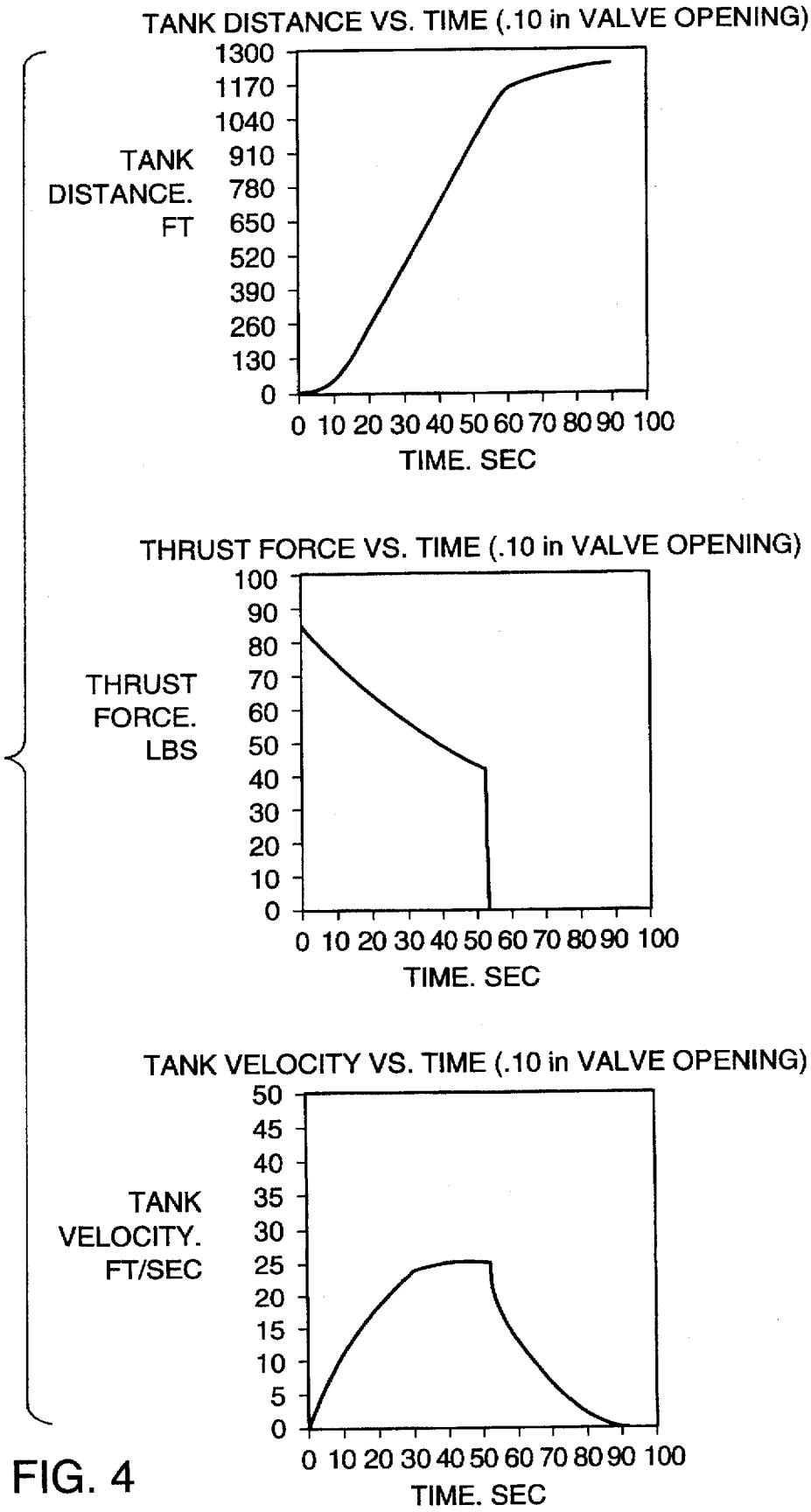
FIGS. 4–7 are graphs showing tank performance for a preferred embodiment of the water jet propulsion device of the present invention.
Figure 5:
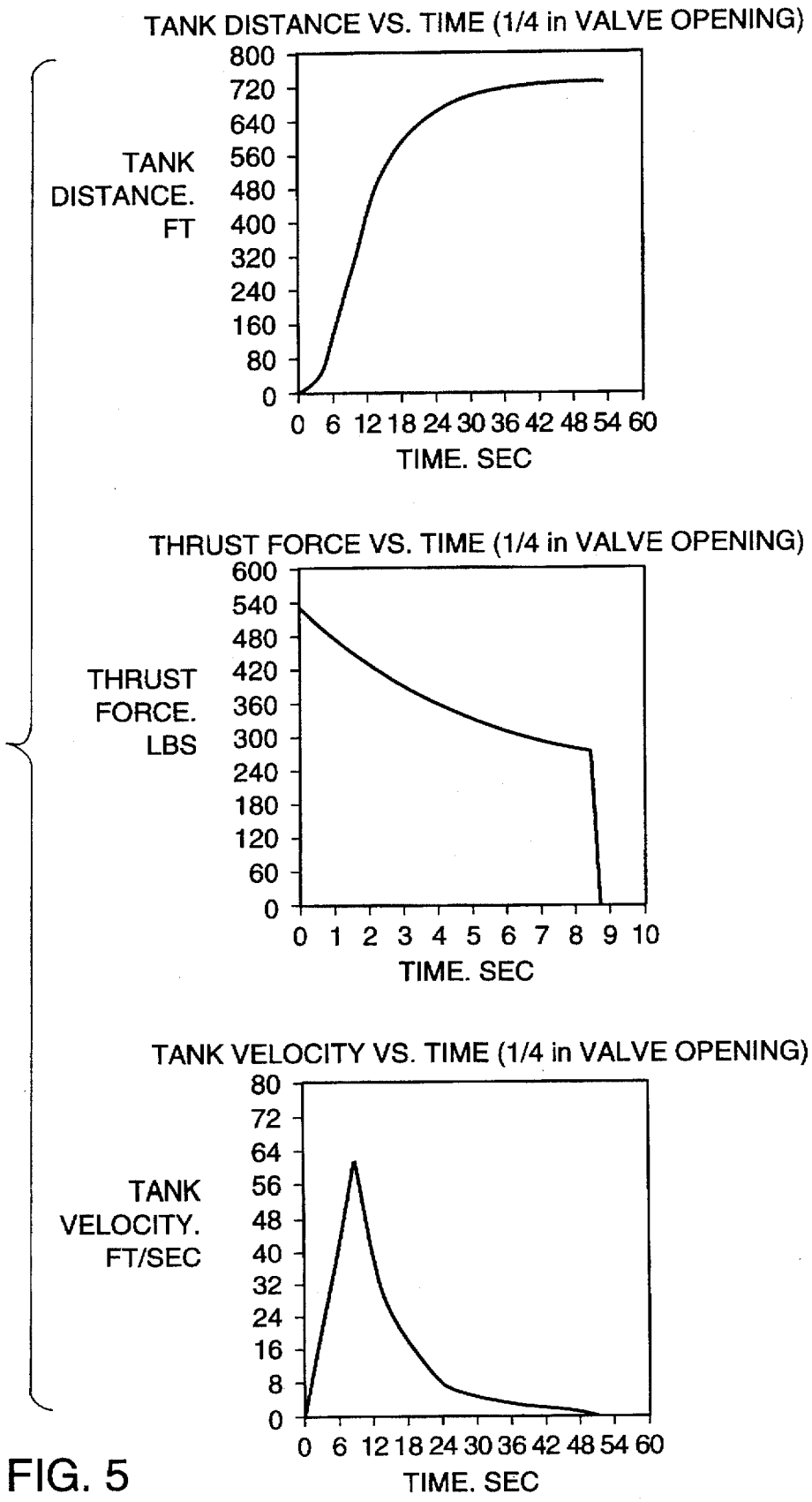
Figure 6:
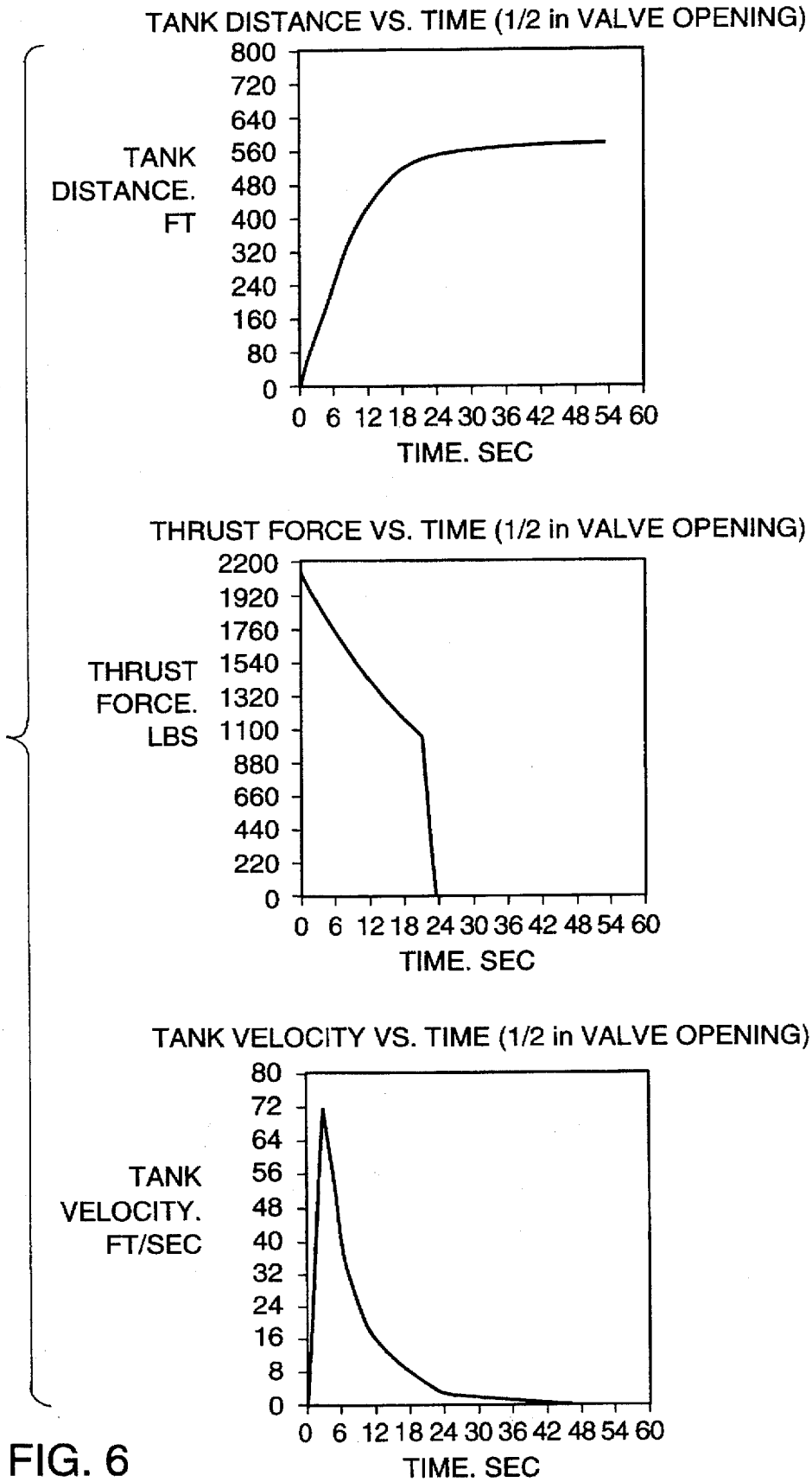
Figure 7:
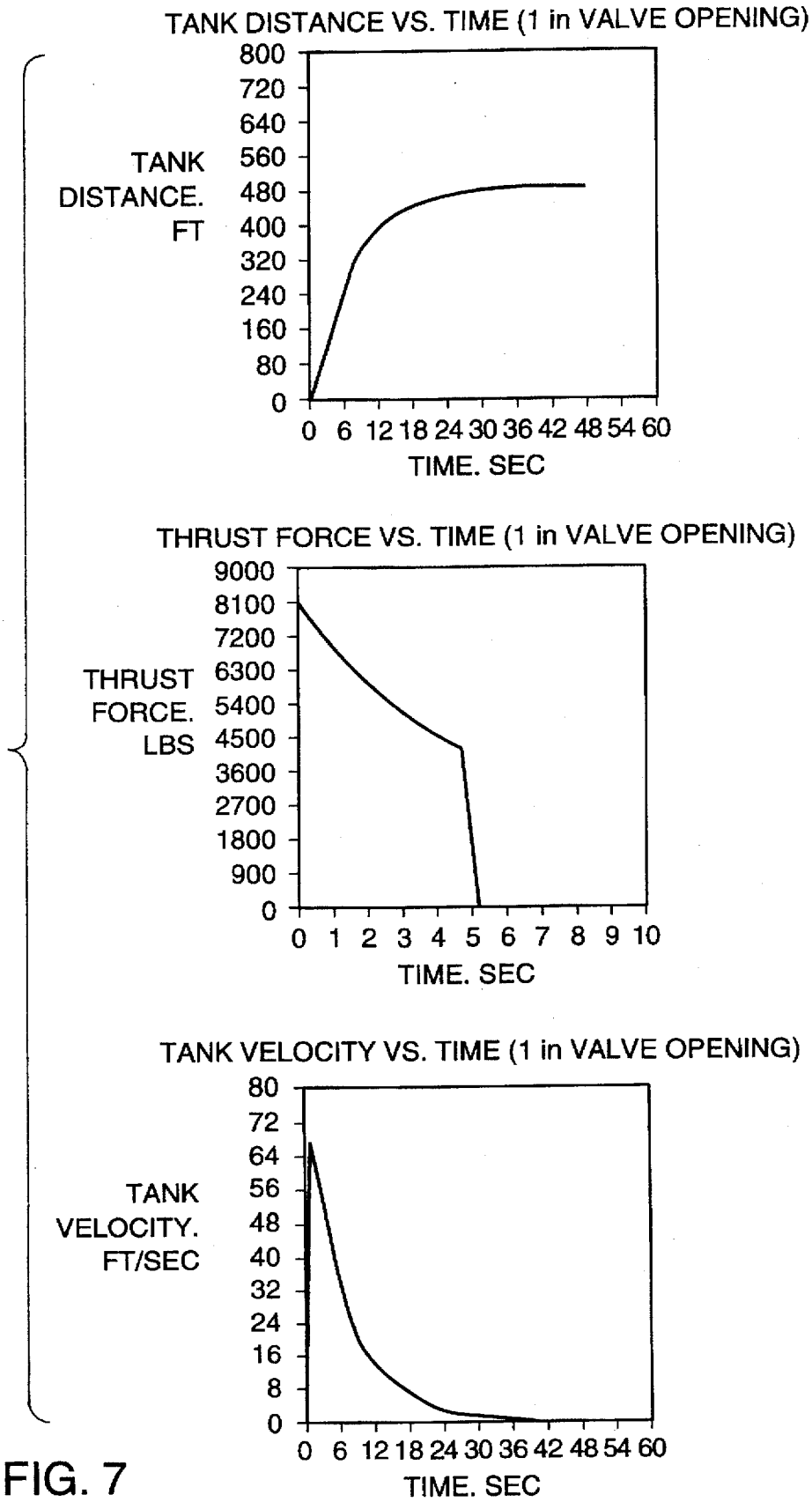

FIGS. 4–7 are time plots of the tank distance, thrust force and tank velocity for different valve opening areas. FIG. 4 contains plots of time vs. tank velocity, thrust force and tank distance for a 1/10 inch diameter valve opening. The numerical results indicate the a tank could travel 1200 feet in 70 seconds with a maximum velocity of 26 feet per second. FIG. 5 contains plots of time vs. tank velocity, thrust force and tank distance for a ¼ inch valve opening. The numerical results indicate the tank could travel 720 feet in 36 seconds with a maximum velocity of 62 feet per second. The remaining figures (FIGS. 6 and 7) are plots of time vs. tank velocity, trust force and distance traveled for valve opening diameters of ½ and 1 inches. The tank could provide an average thrust force of 1300 lbs for a time of 2 seconds and reach a maximum velocity of 72 feet per second for a valve opening of ½ inch. For a valve opening of 1 inch, the tank could provide an average thrust force of 5500 lbs for a time of 0.5 seconds with a maximum velocity of 68 feet per second.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. A water jet propulsion device comprising:

a housing means having a rigid cylindrical form;

a pressurized gas containing means having pressurized gas therein positioned inside said housing means;

a liquid containing means having liquid therein positioned inside said housing means behind the pressurized gas containing means;

a flexible pressure transmission means interposed between the forward pressurized gas containing means and the liquid containing means; and an aft liquid release means in communication with the liquid containing means for releasing liquid there from under pressure.

2. The propulsion device of claim 1 wherein the housing means comprises:

a forward section having a rear terminal peripheral flange;

an aft section having a forward terminal peripheral flange which adjoins said rear terminal peripheral flange of forward section; and a longitudinal connector means connecting said flanges.

3. The propulsion device of claim 1 wherein the forward section of the housing means has a rounded front end.

4. The propulsion device of claim 3 wherein the aft section of the housing means has a tapered rear end.

5. The propulsion device of claim 4 wherein the forward and aft sections of the housing means are each equipped with mounting bracket means.

6. The propulsion device of claim 2 wherein the forward gas containing means is at least partially positioned within the forward section of the housing means.

7. The propulsion device of claim 6 wherein the aft liquid containing means is positioned within at least part of the after section of the housing means.

8. The propulsion device of claim 7 further comprising a gasket positioned between the elastomeric membrane and at least one of said flanges.

9. The propulsion device of claim 1 wherein the flexible pressure transmission means is an elastomeric membrane interposed between the rear terminal peripheral flange of the forward section.

10. The propulsion device of claim 9 wherein the membrane has a forward side and an aft side and is in contact with pressurized gas on the membrane forward side and liquid on the membrane aft side.

11. The propulsion device of claim 10 wherein the membrane is rearwardly deformable by means of the pressurized gas.

12. The propulsion device of claim 11 further comprising a membrane support means positioned in said housing means to prevent excessive rearward deformation of the membrane.

13. The propulsion device of claim 12 wherein the membrane bears against the membrane support means when the liquid has been released from the liquid containing means.

14. The propulsion device of claim 13 wherein the membrane support means is concave.

15. The propulsion device of claim 13 wherein the membrane support means is conical.

16. The propulsion device of claim 1 wherein the liquid release means comprises:

a valve in communication with said liquid containing means; and a nozzle joined in the opposite side of said valve from said liquid containing means.

17. The propulsion device of claim 16 wherein the flexible pressure transmisson means is an elastomeric membrane interposed between the rear terminal peripheral flange of the forward section.

18. The propulsion device of claim 17 further comprising a membrane support means positioned in said housing means to prevent excessive rearward deformation of the membrane.

* * * * *